US007470223B1

(12) United States Patent
Haese

(10) Patent No.: US 7,470,223 B1
(45) Date of Patent: Dec. 30, 2008

(54) EXERCISE APPARATUS USING HIGH DRAG FAN

(76) Inventor: Douglas Haese, 17214 N. 56th Pl., Scottsdale, AZ (US) 85254

( * ) Notice: Subject to any disclaimer, the term of this patent is extended or adjusted under 35 U.S.C. 154(b) by 0 days.

(21) Appl. No.: 11/705,176

(22) Filed: Feb. 9, 2007

(51) Int. Cl.
*A63B 21/008* (2006.01)

(52) U.S. Cl. ..... 482/111; 482/73

(58) Field of Classification Search ..... 482/53, 482/58, 64, 73, 111, 103; 473/228, 229
See application file for complete search history.

(56) References Cited

U.S. PATENT DOCUMENTS 1,279,633 A * 9/1918 Allen ..... 482/111
3,438,627 A * 4/1969 La Lanne ..... 482/103
3,876,212 A 4/1975 Oppenheimer
3,942,794 A 3/1976 Gowins
4,047,715 A 9/1977 Gjessing
4,082,267 A 4/1978 Flavell
4,249,725 A * 2/1981 Mattox ..... 482/111
4,373,717 A * 2/1983 Lambert, Jr. ..... 482/45
4,470,597 A * 9/1984 McFee ..... 482/2
4,537,396 A 8/1985 Hooper
4,743,011 A * 5/1988 Coffey ..... 482/73
4,746,112 A * 5/1988 Fayal ..... 482/73
4,772,013 A * 9/1988 Tarlow, Jr. ..... 482/73
4,784,385 A * 11/1988 D'Angelo ..... 482/111
4,846,460 A 7/1989 Duke
4,856,773 A * 8/1989 Deola ..... 482/102
4,997,181 A 3/1991 Lo
5,020,792 A * 6/1991 Chen ..... 482/59
5,039,091 A 8/1991 Johnson
5,042,798 A * 8/1991 Sawicky ..... 482/129
5,156,402 A 10/1992 Hart
5,304,104 A 4/1994 Chi
5,382,210 A * 1/1995 Rekers ..... 482/72
5,417,634 A * 5/1995 Habing ..... 482/99
5,529,552 A 6/1996 Biedermann et al.
5,697,869 A * 12/1997 Ehrenfried et al. ..... 482/6
5,938,551 A * 8/1999 Warner ..... 474/111
6,066,077 A * 5/2000 Horst ..... 482/114
6,561,955 B1 * 5/2003 Dreissigacker et al. ..... 482/57
6,565,491 B1 5/2003 Thompson et al.
6,569,065 B1 * 5/2003 Menold et al. ..... 482/72
D477,040 S 7/2003 Conklin
6,612,845 B1 9/2003 Macri et al.
6,790,163 B1 9/2004 Van De Laarschot et al.
6,837,808 B1 * 1/2005 Hatch ..... 473/424
7,056,224 B1 6/2006 Keyes
7,125,340 B1 * 10/2006 Priester et al. ..... 473/228

(Continued)

FOREIGN PATENT DOCUMENTS

WO WO2005/016464 A1 2/2005

*Primary Examiner*—LoAn H. Thanh
*Assistant Examiner*—Daniel F Roland
(74) *Attorney, Agent, or Firm*—Frank J. McGue

(57) ABSTRACT

An exercise apparatus provides variable resistance and includes a high drag fan which includes a plurality of fan blades radially mounted on an axle. A multi-ratio pulley system is operably mounted to the axle with the differing ratios providing variable resistance. A cord is wound on a cord reel which is operably engaged with the multi-ratio pulley system. Thus, pulling the cord turns the cord reel which then rotates the multi-ratio pulley system and the high drag fan via the axle. The distal end of the cord opposing the cord reel has an apparatus attachment point.

11 Claims, 2 Drawing Sheets

U.S. PATENT DOCUMENTS

2001/0008861 A1* 7/2001 Dreissigacker et al. ..... 482/111
2004/0152534 A1* 8/2004 Chapman et al. ..... 473/257
2004/0229708 A9* 11/2004 Novotny ..... 473/257
2005/0014571 A1 1/2005 Varner
2006/0121999 A1 6/2006 Varner
2007/0054790 A1* 3/2007 Dodge et al. ..... 482/121
2007/0082793 A1* 4/2007 Yang ..... 482/72

* cited by examiner

EXERCISE APPARATUS USING HIGH DRAG FAN

TECHNICAL FIELD

The present invention relates generally to exercise machines and, more particularly, to an exercise machine which utilizes variable resistance derived from the use of a high drag fan in combination with attachment means for strength training the actual motion used in a particular sporting activity.

BACKGROUND OF THE INVENTION

Exercise machines are well known in the prior art. These machines use a variety of resistance mechanisms and allow a number of different motions for strength training. For example, U.S. Pat. No. 4,537,396 entitled "Energy Absorber for Exercising Machines" which issued on Aug. 27, 1985 to Hooper discloses an exercise device utilizing an air displacement fan which is operated by pull cords while U.S. Pat. No. 5,039,091 entitled "Exercising Machine Having Flywheel With Variable Resistance" which issued on Aug. 13, 1991 to Johnson shows an exercise machine using a variable resistance flywheel which enables the user to perform golf club swings, baseball bat swings, canoeing strokes, football kicks, tennis serves, ball throwing, weight lifting, bike exercise and numerous other athletic motions with pre-selected amounts of resistance.

Other examples of exercise machines disclose numerous devices which allow a user to perform various athletic motions while using said devices including swing training (U.S. Pat. No. 7,056,224), strength training for tennis, baseball, golf or the like (U.S. Pat. No. 6,565,491), strength training (U.S. Pat. No. 5,529,552), baseball batting (U.S. Pat. No. 3,942,794), body movements in general (U.S. Pat. No. 6,612,845), swing training for baseball, golf, hockey, tennis, cricket and the like (U.S. Pat. Nos. 5,156,402, 3,876,212 and U.S. Published Application US2005/0014571).

None of the prior art employs the combination of high fan drag and attachment means for strength training the actual motion used in a particular sporting activity.

SUMMARY OF THE INVENTION

It is an object of this invention to provide an exercise machine which uses high fan drag for variable resistance.

It is a further object of this invention to provide an exercise machine having attachment means for strength training the actual motion used in a particular sporting activity.

Further objects and advantages of the invention will become apparent as the following description proceeds and the features of novelty which characterize this invention will be pointed out with particularity in this specification and the claims below.

BRIEF DESCRIPTION OF THE DRAWINGS

The present invention may be more readily described by reference to the accompanying drawings in which.

DETAILED DESCRIPTION OF THE PREFERRED EMBODIMENT

Figure 1:
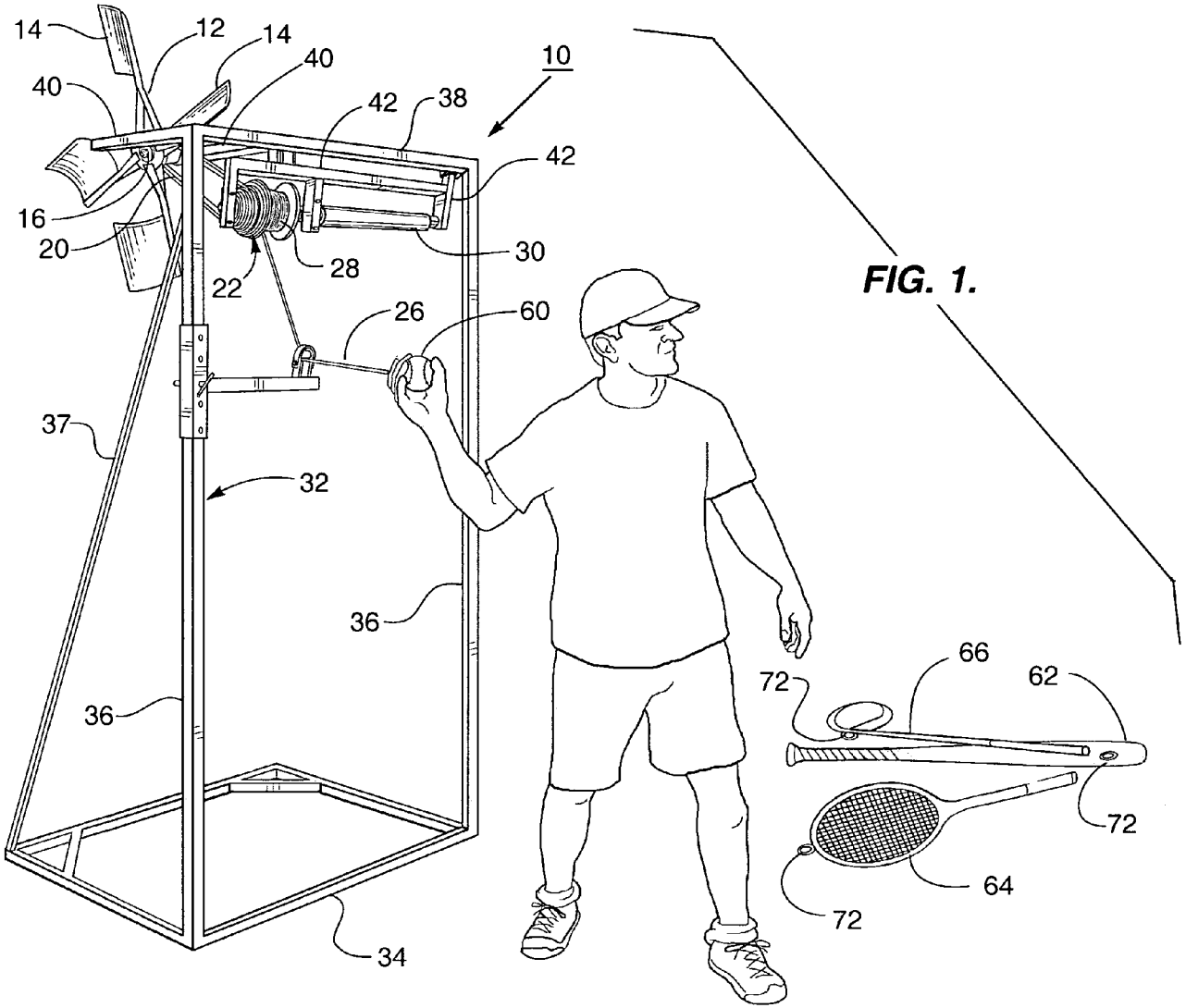
FIG. 1 is a side and front perspective view of the present invention.
Figure 2:
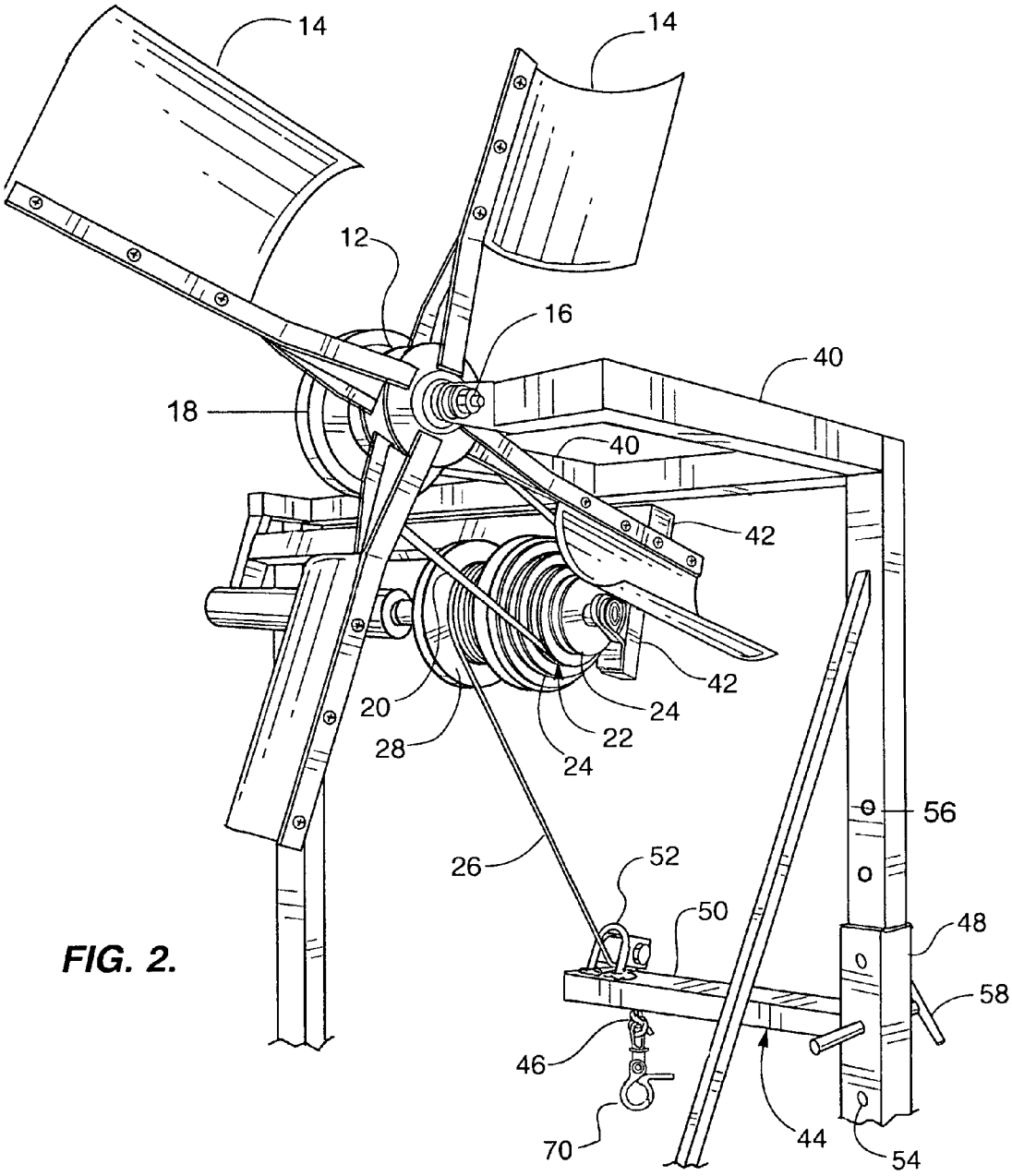
FIG. 2 is a close up perspective view of the present invention.

The present invention is an exercise apparatus 10 that provides variable resistance primarily from the use of a high drag fan 12. High drag fan 12 includes a plurality of fan blades 14 radially mounted on an axle 16. A pulley 18 is also mounted to axle 16. A belt 20 extends from pulley 18 to a multi-ratio pulley system 22 which comprises a number of different pulleys 24, each having a different diameter to provide variable resistance. Moving belt 20 between the different pulleys 24 changes the resistance.

In turn, pulley system 22 is axially mounted with and driven by a simple cord 26 which is wound around a cord reel 28. Pulling cord 26 turns cord reel 28, which rotates pulley system 22, belt 20, pulley 18 and finally fan 12 via axle 16. A recoiling mechanism 30 is provided which automatically rewinds cord 26 onto cord reel 28 once an exercise movement is completed.

The recited elements are mounted to the top of a frame 32 which comprises a rectangular base 34, which, in the illustrated embodiment, comprises square tubing. Two vertical square tubes 36 extend upwardly from adjacent corners of base 34 and are joined at the top by a horizontal square tube 38. A brace piece 37 extends rearwardly and downwardly from an upper portion of one of said vertical square tubes 36 to engage another corner of base 34 for extra strength. Extending rearwardly from horizontal square tube 38 are a first pair of mounting brackets 40 which rotatably capture axle 16 therebetween. A second pair of mounting brackets 42 extend rearwardly and downwardly from horizontal square tube 38 rotatably capture pulley system 22, cord reel 28 and recoiling mechanism 30 therebetween.

Cord 26 extends downwardly and passes through a guide 44 to an apparatus attachment point 46. Guide 44 is mounted to vertical square tube 36, preferably the one of the vertical square tubes 36 having brace 37 mounted thereto. Guide 44 includes a sleeve 48 which slidably engages vertical square tube 36 and a horizontal mount 50 which laterally extends towards the other of the vertical square tubes 36. A U-shaped bracket 52 is positioned at the distal end of mount 50 to received cord 26 therethrough.

Sleeve 48 includes a plurality of holes 54 which align with a corresponding plurality of holes 56 provided in vertical square tube 36. A T-handle 58 is adapted to threadedly extend through sleeve 48 and vertical square tube 36 to allow height adjustment for users of varying heights as well as for differing sporting activities by simply turning T-handle 58 in either direction.

Apparatus attachment point 46 is adapted to allow a user to affix many different sporting goods thereto, including, but not limited to, a baseball 60, a baseball bat 62, a tennis racket 64, a golf club 66 and the like. In a simple embodiment, apparatus attachment point 46 is a lobster claw latch 70 which engages an eyebolt 72 mounted on a particular piece of sporting equipment.

In use, the sporting goods, for example, baseball 60, is affixed to the apparatus attachment point. The user then "pitches" baseball 60 using the actual motion for same. Fan 12 fan provides resistance to the movement. The purpose of the apparatus is to provide strength training to the actual motion used in a particular sporting activity. Thus, a pitcher would strengthen all the muscles used to pitch, the batter would strengthen the muscles used in batting, a tennis player would strengthen the muscles used for tennis, etc.

While the invention has been particularly shown and described with reference to a preferred embodiment. it will be understood by those skilled in the art that various changes in form and detail may be made therein without departing from the spirit and scope of the invention.

The invention claimed is:

1. An exercise apparatus provides variable resistance which comprises:

a drag fan which includes a plurality of fan blades radially mounted on an axle, a multi-ratio pulley system operably mounted to the axle, the differing ratios providing variable resistance, a cord wound on a cord reel, the cord reel being operably engaged with the multi-ratio pulley system whereby pulling the cord turns the cord reel, which rotates the multi-ratio pulley system and the drag fan via the axle, a distal end of the cord opposing the cord reel having an apparatus attachment point, and a guide having the cord pass therethrough, the guide being slidably mounted to a first vertical element for height adjustment, the guide including a sleeve which slidably engages the first vertical element and a horizontal element which laterally extends towards a second vertical element, the guide further having a U-shaped bracket that is positioned at the distal end of the horizontal mount which receives the cord.

2. The exercise apparatus of claim 1 wherein the multi-ratio pulley system comprises a pulley mounted to the axle, a belt extending from the pulley to a plurality of different pulleys, each having a different diameter whereby moving the belt from one of the different pulleys to another of the different pulleys alters the resistance.

3. The exercise apparatus of claim 1 wherein a recoiling mechanism is provided which automatically rewinds the cord onto the cord reel once the cord is no longer being pulled.

4. The exercise apparatus of claim 1 further comprising a frame.

5. The exercise apparatus of claim 4 wherein the frame comprises a rectangular base, the first and second vertical elements extending upwardly from adjacent corners of the base, the first and second vertical elements being joined at the top by a horizontal element, a first mounting bracket mounted to the horizontal element rotatably capturing the axle therebetween and a second mounting bracket extending rearwardly and downwardly from the horizontal element to rotatably capture the multi-ratio pulley system, the cord reel and the recoiling mechanism therebetween.

6. The exercise apparatus of claim 5 further comprising a brace piece extending rearwardly and downwardly from an upper portion of one of said vertical elements to engage another corner of the base thereby providing for extra strength.

7. The exercise apparatus of claim 1 wherein the sleeve includes a plurality of holes which align with a corresponding plurality of holes provided in the first vertical element, a pin being adapted to extend through the sleeve and the first vertical element to allow the height adjustment.

8. The exercise apparatus of claim 1 wherein the apparatus attachment point is adapted to allow a user to affix many different sporting goods.

9. The exercise apparatus of claim 8 wherein the apparatus attachment point is a loop at the distal end of the cord, the loop adapted to engage a hook mounted to the different sporting goods.

10. An exercise apparatus provides variable resistance which comprises:

a drag fan which includes a plurality of fan blades radially mounted on an axle, a multi-ratio pulley system operably mounted to the axle, the differing ratios providing variable resistance, the multi-ratio pulley system comprising a pulley mounted to the axle, a belt extending from the pulley to a plurality of different pulleys, each having a different diameter whereby moving the belt from one of the different pulleys to another of the different pulleys alters the resistance, a cord wound on a cord reel, the cord reel being operably engaged with the multi-ratio pulley system whereby pulling the cord turns the cord reel, which rotates the multi-ratio pulley system and the drag fan via the axle, a distal end of the cord opposing the cord reel having an apparatus attachment point, the apparatus attachment point being adapted to allow a user to affix many different sporting goods thereto, the apparatus attachment point being a loop at the distal end of the cord, the loop adapted to engage a hook mounted to the different sporting goods;

a guide having the cord pass therethrough, the guide being slidably mounted to a first vertical element for height adjustment, the guide including a sleeve which slidably engages the first vertical element and a horizontal mount which laterally extends towards a second vertical element, the sleeve including a plurality of holes which align with a corresponding plurality of holes provided in the first vertical element, a pin being adapted to extend through the sleeve and the first vertical element to allow the height adjustment, the guide further having a U-shaped bracket that is positioned at a distal end of the horizontal mount which receives the cord;

a recoiling mechanism is provided for automatically rewinding the cord onto the cord reel once the cord is no longer being pulled; and a frame comprising a rectangular base, the first and second vertical elements extending upwardly from adjacent corners of the base, the first and second vertical elements being joined at the top by a horizontal element, a first mounting bracket mounted to the horizontal element rotatably capturing the axle therebetween and a second mounting bracket extending rearwardly and downwardly from the horizontal element to rotatably capture the multi-ratio pulley system, the cord reel and the recoiling mechanism therebetween.

11. The exercise apparatus of claim 10 further comprising a brace piece extending rearwardly and downwardly from an upper portion of one of said vertical elements to engage another corner of the base thereby providing for extra strength.

* * * * *